US005177814A

United States Patent [19]

Courtney

[11] Patent Number: 5,177,814

[45] Date of Patent: Jan. 12, 1993

[54] SHIRT RETAINER

[76] Inventor: Patricia K. Courtney, 5907 Royal Point, San Antonio, Tex. 78239

[21] Appl. No.: 698,281

[22] Filed: May 10, 1991

[51] Int. Cl.[5] ..... A41F 1/00

[52] U.S. Cl. ..... 2/326; 2/327; 2/323; 2/340

[58] Field of Search ..... 2/326, 327, 323, 340; 604/385, 386, 387, 388, 393, 399, 401

[56] References Cited

U.S. PATENT DOCUMENTS

| | | | |
|---|---|---|---|
| 311,111 | 1/1885 | Eisler | 2/326 |
| 755,188 | 3/1904 | Tooker | 2/326 |
| 863,970 | 8/1907 | Ebersole | 2/326 |
| 1,334,514 | 3/1920 | Beitter | 2/327 |
| 1,653,288 | 3/1927 | Johnson | 2/326 |
| 2,727,247 | 12/1955 | Bailey | 2/323 |
| 3,052,891 | 9/1962 | Panepinto | 2/301 |
| 4,596,569 | 6/1986 | Campbell | 604/387 |
| 4,853,979 | 8/1989 | Ryder | 2/326 |
| 4,937,886 | 7/1990 | Ellis | 2/326 |

*Primary Examiner*—Werner H. Schroeder
*Assistant Examiner*—Gloria Hale
*Attorney, Agent, or Firm*—John M. Harrison

[57] ABSTRACT

A resilient shirt retainer for retaining the shirttails of a garment in tucked, fully extended or deployed configuration on the body of a wearer. The shirt retainer includes a pair of narrow, elastic cross-straps disposed in an X-configuration and stitched at the center where the straps cross, each of the elastic cross-straps being covered with a pleated cloth sheath. A retainer clip is attached to each end of the cross-straps for removably securing the cross-straps to the front and rear shirttail portions of the garment. The cross-straps are deployed between the infant's legs to maintain the shirttails in a tucked or downwardly-deployed configuration.

2 Claims, 1 Drawing Sheet

SHIRT RETAINER

BACKGROUND OF THE INVENTION

1. Field of the Invention

This invention relates to shirt retaining devices and more particularly, to a shirt retainer which is characterized by a pair of cross-straps configured in an "X" configuration and fitted with retainer clips for engaging the front and rear shirttail portions of an infant garment and maintaining the shirttails in a downwardly-deployed or tucked orientation. In a preferred embodiment the cross-straps are stitched to each other at or near the center and are each characterized by a narrow strip of elastic band having a decorative pleated cloth sheath to provide comfort and resiliency as the infant moves. The shirt retainer is light in weight, comfortable and easy to attach and remove.

One of the problems which is inherent in maintaining the lower body or trunk portion of an infant or child covered by a shirt or other garment, is the almost constant motion of the infant, which tends to force the shirttail upwardly, particularly while the infant is playing or sleeping. Accordingly, on cool nights, the infant is more susceptible to catching cold when the shirttail is forced toward or under the armpits due to repetitive movement on the mattress or floor.

2. Description of the Prior Art

Various techniques are known for maintaining the shirttail of an infant deployed downwardly around the waist and lower trunk. Perhaps the most simple technique is the use of safety pins to pin the shirttail to the front and rear diaper or pant margins and achieve this purpose. However, this technique suffers from the disadvantage of having to periodically deploy and remove the safety pins when changing diapers and pants. U.S. Pat. No. 2,727,247, dated Dec. 20, 1955, to T. Bailey, details a "Shirt Retaining Device", which is characterized by a wide, diaper-like structure fitted with four straps or bands having clips on the ends for attachment to the shirt of the infant and maintaining the shirt in a downwardly-deployed configuration over the lower torso of the infant. U.S. Pat. No. 3,052,891, dated Sep. 11, 1962, to A. Panepinto, details a "Garment Support", such as suspenders, which includes straps fitted with clamps at the ends for attachment to a pair of pants in the front and rear thereof. A "Shirt Hold-Down Device" is detailed in U.S. Pat. No. 4,596,569, dated Jun. 24, 1986, to Elizabeth T. Campbell. The device is designed for diaper-wearing infants and toddlers and includes an elongated, elastic panel fitted between the legs, over the diaper or diaper holder and having garter-type fasteners on each end for gripping the shirt. Like the device detailed in U.S. Pat. No. 2,727,247, to Bailey, the relatively wide, diaper-like panel is fitted with four fasteners for securing the front and rear shirttail portions of an infant's shirt. Another "Infant Hold Down Device" is detailed in U.S. Pat. No. 4,937,886, dated Jul. 3, 1990, to Barbara S. Ellis. The device is designed as an accessory for use in combination with a small child or infant's clothing and includes a relatively wide, elongated central section having a pair of straps extending from each end, each strap provided with a selectively operable fastener at the end for attachment to the front and rear shirttail portions of an infant.

It is an object of this invention to provide a new and improved, comfortable and efficient shirt retainer for securing the front, side and rear shirttail portions of an infant garment in tucked or downwardly-extended configuration.

Another object of the invention is to provide a shirt retainer which is characterized by a pair of narrow cross-straps shaped in the configuration of an "X", stitched at the intersection and provided with retainer clips at the ends thereof for engaging and retaining the front and rear portions of a child or infant's shirt or garment in hip-engaging configuration.

Still another object of this invention is to provide a shirt retainer for maintaining the front and rear shirttail portions of a child or infant's shirt or garment in waist and hip-covering configuration, which shirt retainer includes a pair of narrow elastic cross-straps, each provided with a pleated outer cloth sheath and garter belt-type clips at the ends, for engaging the front and rear portions of the shirttail and maintaining the shirt or garment in fully deployed orientation on the infant or child.

SUMMARY OF THE INVENTION

These and other objects of the invention are provided in a new and improved shirt retainer for infants and children, which shirt retainer includes a pair of cross-straps, each constructed of a narrow, resilient, stretchable, elastic material having a pleated cloth sheath thereon, arranged in an "X" configuration, stitched at the intersection and fitted with retainer clips at the extending ends, for engaging the front and rear portions of the infant's shirttail or garment and maintaining the shirt or garment in a covering configuration over the upper, middle and lower torso of the infant.

BRIEF DESCRIPTION OF THE DRAWING

The invention will be better understood by reference to the accompanying drawing, wherein.

DESCRIPTION OF THE PREFERRED EMBODIMENTS

Figure 1:
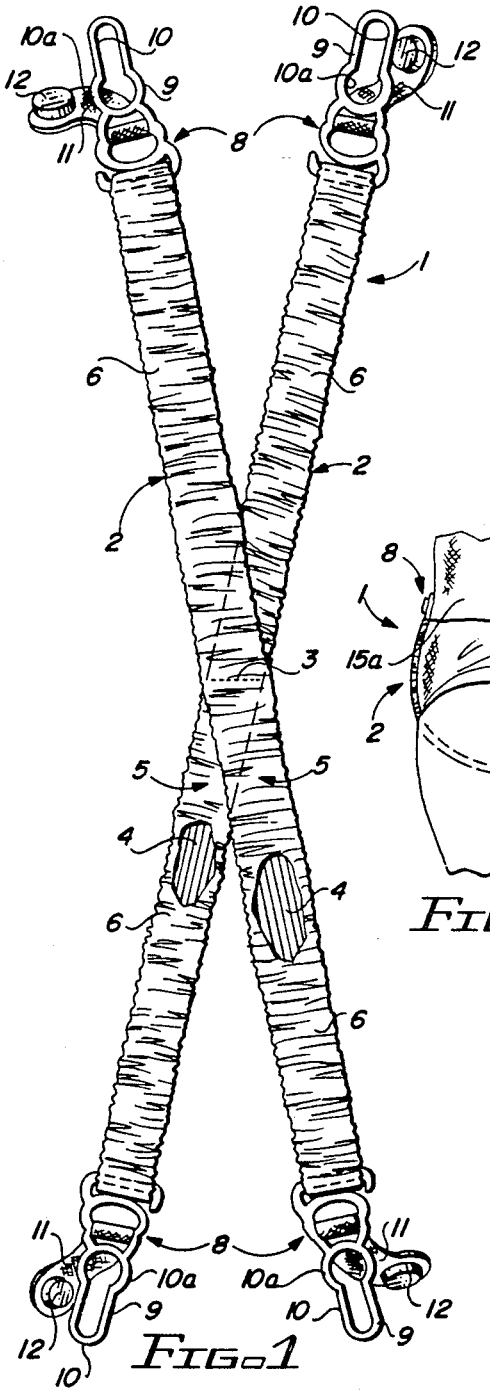
FIG. 1 is a perspective view of a preferred embodiment of the shirt retainer of this invention.
Figure 2:
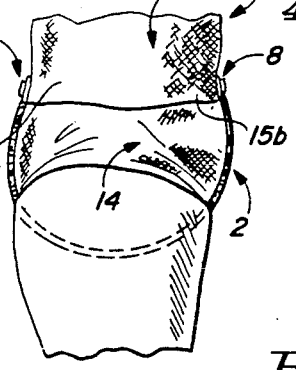
FIG. 2 is a side view, partially in section, of a preferred deployment of the shirt retainer illustrated in FIG. 1 on an infant.

Referring initially to FIG. 1 of the drawing, in a preferred embodiment the shirt retainer of this invention is generally illustrated by reference numeral 1 and includes a pair of narrow, elongated cross-straps 2, deployed in the configuration of an "X" as illustrated. In a most preferred embodiment the cross-straps 2 are connected near the center by center stitching 3 and are each characterized by a narrow elastic band 4, fitted with a cloth sheath 5. In another most preferred embodiment the cloth sheath 5 is sewn or otherwise attached to a corresponding elastic band 4 while the elastic band 4 is in stretched configuration, such that release of each elastic band 4 causes the encapsulating cloth sheath 5 to assume the pleated configuration illustrated in FIG. 1. Accordingly, the multiple pleats 6 facilitate considerable stretching and elongating of the elastic bands 4 without inhibition, as hereinafter further described. A retainer clip 8 is sewn or otherwise attached to each end of each of the cross-straps 2 and each of the retainer clips 8 includes a rigid, flat keeper frame 9, provided with a narrow frame slot 10 and a rounded frame eye 1O*a*, located inwardly of the frame slot 10. A resilient, flexible retainer flap 11 is attached to the keeper frame 9 and is provided with a disc-shaped keeper 12 at the free end thereof. The keeper 12 is designed to first engage the shirttail of a garment and then the frame eye 1O*a* and slide into the frame slot 10 to secure the shirttail on each end of the cross-straps 2, as hereinafter further described.

Figure 3:
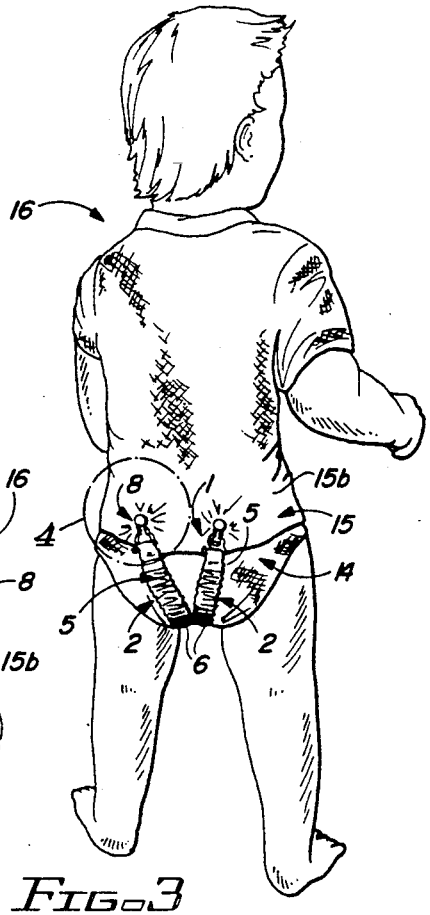
FIG. 3 is a rear perspective view of the shirt retainer illustrated in FIG. 1 in deployed configuration.
Figure 4:
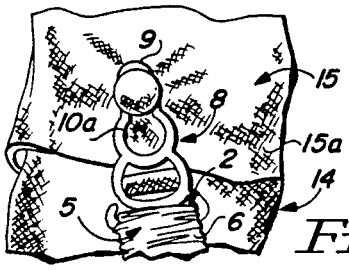
FIG. 4 is an enlarged side view, more particularly illustrating attachment of a typical garter retainer clip to the shirttail of an infant.
Figure 5:
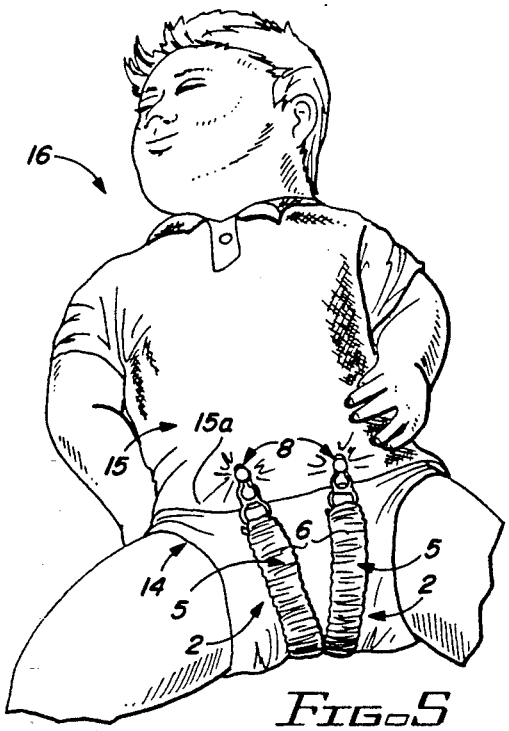
FIG. 5 is a front perspective view of the infant and deployed shirt retainer illustrated in FIG. 3, more particularly illustrating the preferred deployment of the shirt retainer on the infant.

Referring now to FIGS. 2–5 of the drawing, the respective retainer clips 8 are deployed in spaced pairs to engage the front shirttail 15*a* and rear shirttail 15*b* of the shirt 15 of an infant 16, by manipulating the cross-straps 2 between the legs of the infant 16 over the diaper or pants 14, for attachment to the front shirttail 15*a* and rear shirttail 15*b* of the shirt 15, as illustrated. Attachment of the retainer clips 8 to the front shirttail 15*a* and rear shirttail 15*b* is effected by initially inserting a portion of the front shirttail 15*a* and rear shirttail 15*b* between corresponding retainer flaps 11 and companion keeper frames 9 and subsequently forcing the respective keeper 12 and shirttail portion into the frame eye 1O*a* of the keeper frame 9, while maintaining the shirttail portions between the keeper frame 9 and the keeper 12, respectively. The respective keeper 12 is then forced forwardly in the corresponding frame slot 10 to removably secure the front shirttail 15*a* and rear shirttail 15*b* of the shirt 15 in a hip-engaging configuration, as illustrated in FIGS. 3–5. It will be appreciated that the respective retainer clips 8 may be quickly and easily removed from attachment to the front shirttail 15*a* and rear shirttail 15*b* by reversing the engaging steps noted above.

It will be appreciated by those skilled in the art that the retainer clips 8 may be replaced by clips of any desirable design, according to the knowledge of those skilled in the art. However, for convenience, ease of manipulation and safety, as well as minimum damage to the shirt 15, the retainer clips 8 are preferred as a means for securing the cross-straps 2 to the front shirttail 15*a* and rear shirttail 15*b*, respectively, of the shirt 15.

A primary factor in the design of the shirt retainer 1 of this invention is the use of two narrow, elongated, elastic cross-straps 2, which are joined at or near the center in an "X" configuration by the center-stitching 3 or by other techniques, such as a brad or the like, in non-exclusive particular. These narrow, elongated, elastic cross-straps 2 are not only exceptionally comfortable to the infant, but they are also decorative, in that the pleated cloth sheaths 5 may be supplied in any desired color and design. The narrow, elongated configuration of the cross-straps 2 allows stretching of the cross-straps 2 independently of each other along the entire length of the cross-straps 2, for added comfort and ease of attachment and removal. Since the cross-straps 2 are not attached to relatively wide diaper panels or holders and are elastic throughout their entire length from the retainer clip 8 at one end to the oppositely-disposed retainer clip 8 at the opposite end, they will not restrict or impede the leg or body movement of the infant.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A shirt retainer for retaining shirttails of an upper body garment in close proximity to the hip area of a wearer by connecting a front shirttail and a rear shirttail, comprising a pair of narrow, elastic bands crossing substantially in the shape of an "X", stitching provided in said elastic bands for joining said elastic bands at said "X", said bands having first spaced ends terminating at the front shirttail of the garment and the bands extending between the legs of a wearer, with second spaced ends of the bands terminating at the rear shirttail of the garment, a pleated cloth sheath encasing said elastic bands and a garter belt retainer clip provided on each of said first spaced ends and said second spaced ends for engaging said front shirttail and said rear shirttail, respectively, and removably securing said first spaced ends on the front shirttail and said second spaced ends on the rear shirttail of the garment.

2. A shirt retainer for retaining a front, side and rear shirttail of a shirt of a wearer at the hip area, comprising a pair of narrow elastic bands deployed between the legs of the wearer in connected, crossed relationship and having oppositely disposed ends, respectively; garter belt retainer clips provided on said ends of said elastic bands, respectively, for engaging the front shirttail and rear shirttail of the shirt, respectively, and a pleated cloth sheath encasing said elastic bands.

* * * * *